US007992718B1

(12) United States Patent
Klunder

(10) Patent No.: US 7,992,718 B1
(45) Date of Patent: Aug. 9, 2011

(54) METHOD FOR ENHANCING SELECTIVITY AND RECOVERY IN THE FRACTIONAL FLOTATION OF PARTICLES IN A FLOTATION COLUMN

(75) Inventor: Edgar B. Klunder, Bethel Park, PA (US)

(73) Assignee: The United States of America as represented by the United States Department of Energy, Washington, DC (US)

( * ) Notice: Subject to any disclaimer, the term of this patent is extended or adjusted under 35 U.S.C. 154(b) by 231 days.

(21) Appl. No.: 12/552,550

(22) Filed: Sep. 2, 2009

(51) Int. Cl.
*B03D 1/02* (2006.01)
*B03D 1/24* (2006.01)

(52) U.S. Cl. ..... 209/164; 209/170

(58) Field of Classification Search ..... 209/164, 209/170
See application file for complete search history.

(56) References Cited

U.S. PATENT DOCUMENTS 6,413,366 B1 * 7/2002 Kemper ..... 162/60
2006/0021916 A1 * 2/2006 Hess et al. ..... 209/164

OTHER PUBLICATIONS

Honaker et al, "Selective detachment process in column flotation froth," Minerals Engineering 19 (2006).
Ata et al, "Collection of hydrophobic particles in the froth phase," Int. Jour. Miner. Process. 64 (2002).
Schultz et al, "The flotation column as a froth separator," Mining Engr. 1450 (1991).

* cited by examiner

*Primary Examiner* — Thomas M Lithgow
(74) *Attorney, Agent, or Firm* — James B. Potts; Mark P. Dvorscak; John T. Lucas

(57) ABSTRACT

The method relates to particle separation from a feed stream. The feed stream is injected directly into the froth zone of a vertical flotation column in the presence of a counter-current reflux stream. A froth breaker generates a reflux stream and a concentrate stream, and the reflux stream is injected into the froth zone to mix with the interstitial liquid between bubbles in the froth zone. Counter-current flow between the plurality of bubbles and the interstitial liquid facilitates the attachment of higher hydrophobicity particles to bubble surfaces as lower hydrophobicity particles detach. The height of the feed stream injection and the reflux ratio may be varied in order to optimize the concentrate or tailing stream recoveries desired based on existing operating conditions.

19 Claims, 3 Drawing Sheets

METHOD FOR ENHANCING SELECTIVITY AND RECOVERY IN THE FRACTIONAL FLOTATION OF PARTICLES IN A FLOTATION COLUMN

STATEMENT OF GOVERNMENTAL SUPPORT

The United States Government has rights in this invention pursuant to the employer-employee relationship of the Government to the inventors as U.S. Department of Energy employees and site-support contractors at the National Energy Technology Laboratory.

TECHNICAL FIELD

A method of particle separation from a feed stream comprised of particles of varying hydrophobicity by injecting the feed stream directly into the froth zone of a vertical flotation column in the presence of a counter-current reflux stream. Bubble-particle attachments occur in the froth zone and froth overflow is transferred to a froth breaker. The froth breaker generates a reflux stream and a concentrate stream, and the reflux stream is injected into the froth zone of the vertical flotation column, such that the reflux stream mixes with the interstitial liquid between bubbles in the froth zone. A net flow of interstitial liquid flows in a downward direction providing a counter-current flow between the plurality of bubbles and the interstitial liquid, allowing higher hydrophobicity particles introduced via the reflux stream to attach to bubble surfaces as lower hydrophobicity particles detach. The height of the feed stream injection and the reflux ratio may be varied in order to optimize the concentrate or tailing stream recoveries desired based on existing operating conditions or other considerations.

BACKGROUND OF THE INVENTION

Froth flotation is one of the primary solid-solid separation processes for fine particles. The process has been widely practiced for a century in the mining industry for concentrating valuable minerals such as copper, lead, zinc, phosphate, precious metals, and coal, among others. Typically the froth flotation process has been developed to work in water with air as the froth generating gas, however other liquid and gas combinations can be used.

In the froth flotation process, one or more specific particulate constituents of a slurry or suspension of finely dispersed particles attach to gas bubbles and are subsequently separated from the other constituents of the slurry or suspension. The froth flotation process exploits the wettability differences of the particles to be separated. Differences in the wettability among solid minerals particles can be natural, or can be induced by the use of chemical additives. The buoyancy of the bubble/particle aggregate, formed by the adhesion of the gas bubble to a particle in the slurry, is such that it rises to the surface of the flotation vessel where it is separated from the remaining particulate constituents which remain suspended in the aqueous phase of the suspension.

In a typical operation, a mineral ore or a coal is pulverized to a fineness suitable for liberating undesired components from the valuable constituent. After the pulverization, the material is conditioned with reagents, known as collectors and surfactants, to render the valuable constituent hydrophobic. In some instances, the contaminant or gangue is rendered hydrophobic. In the case of coal, hydrocarbon oils are often used as collectors. After conditioning, the material is carried by a feed stream to a liquid containing flotation column and the feed stream injects directly into the liquid at a height typically somewhere in the upper third of the column. At the same time gas bubbles are introduced at the bottom of the column. Once introduced into the flotation column, the material in the feed stream moves downward in the flotation column liquid while the gas bubbles move upward, producing counter-current flow. This countercurrent feeding arrangement promotes an interceptional collision between the particles in the feed stream and the gas bubbles, and produces a collection zone in the flotation column. In the collection zone, of the particles that collide with the gas bubbles, those that are sufficiently hydrophobic are collected by the bubbles and rise through the collection zone as bubble-particle aggregates. Above the collection zone, the bubble-particle aggregates gather and form a froth zone. The bubble-particle aggregates move upward through the froth zone and exit the flotation column at a froth overflow, where the froth is broken and the particles are liberated from the bubble-particle aggregates. In this manner, generally speaking, feed streams containing both hydrophobic and hydrophillac particles may be separated, with generally the more hydrophobic particles reporting to the froth and the more hydrophilic particles exiting the column through the tailings port.

The effectiveness of these methods is often measured in terms of recovery and grade. Recovery refers to the amount of the valuable constituent in the product stream relative to the amount of that constituent in the feed stream. Grade refers to the concentration of the valuable constituent in the product stream relative to the concentration of all the constituents in the concentrate stream. Higher recoveries and grades are desired in a separation process.

Conventional methods suffer when the feed stream is comprised of particles of varying hydrophobicity, and the goal of the process is separation of particles having the strongest hydrophobicity. One example is an application intended to separate coal from a feed stream having particles comprised of both coal and low grade ash and sulfur. A particle that contains as little as 10% coal on its surface, and thus represents a high ash content particle, has a good chance to report to the flotation product as a result of bubble attachment to the coal portion of the particle surface. As a result, the bubble-particle aggregates which move upward through the froth zone and exit at the froth overflow includes a higher than desired content of the low grade ash and sulfur when the froth is broken.

It is known that one method of reducing the quantity of high ash content particles reporting to the froth breaker is through the mechanism of internal reflux. As the bubble-particle aggregates proceed upward through the flotation column, interstitial liquid between the bubbles drains away and the bubbles begin to coalesce. This coalescence liberates formerly attached particles and reduces the bubble surface area available for reattachment. Competition for the reduced bubble surface area favors the more hydrophobic particles, and the quantity of lower hydrophobic, high ash content particles reporting to the froth breaker is reduced. Some flotation columns are designed to intentionally increase the extent of bubble coalescence that occurs, thereby increasing the internal reflux and reducing the quantity of lower hydrophobic particles in the end product. However, control of the process is difficult when the extent of bubble coalescence is a direct function of original separation column design, and the operating environment deviates significantly from the design environment. In such cases, varying combinations of wash-water rate, gas rate, feed rate, and other operating parameters must be attempted in order to obtain an end product possessing the desired recovery and grade. It would be advantageous if control over end-product recovery and grade was available through adjustment of more discrete operating parameters.

Another method of increasing the grade involves the introduction of higher hydrophobicity material into the froth zone following particle collection by feed injection into the liquid zone. See e.g., Honaker et al, "Selective detachment process in column flotation froth," *Minerals Engineering* 19 (2006), and see Ata et al, "Collection of hydrophobic particles in the froth phase," *Int. Jour. Miner. Process.* 64 (2002). In these methods, a foreign material having high hydrophobicity is added directly to a particle-laden froth, so that during bubble coalescence the reduced bubble surface area will favor attachment of the added foreign material, and less hydrophobic materials will be selectively detached. This methodology can increase the grade of the end-product feed stream with respect to the valuable, hydrophobic constituent, however by the nature of the process the end-product feed stream also contains the foreign material. This foreign material must then be subsequently removed, adding additional operational steps in addition to the prerequisite supply of the foreign material itself. It would be advantageous if this selectivity mechanism could be employed in a manner obviating introduction of foreign material, so that the need for a supply and subsequent removal could be eliminated. Further, it would be advantageous if the selectivity mechanism did not employ bubble coalescence as a requirement, such that more stable froths could be utilized.

Additionally, the interstitial liquid existing between bubbles in the froth zone contains a significant amount of the less hydrophobic or even hydrophilic material. This material may also be carried over to the froth breaker with the interstitial liquid, producing a higher than desired amount of low grade materials in the end product. To combat this particular problem, clean wash-water is applied to the top of the froth. The clean wash-water generally flows downward through the froth and displaces the interstitial water containing the less hydrophobic and hydrophilic materials, so that those materials are washed from the froth and removed as a tailings stream. This is a widely practiced and generally effective technique in industry, however the necessity for a continuous source of clean wash-water is a significant operational requirement. Wash-water rates of 3-5 gpm/ft$^2$ are typical for commercial installations. Additionally, optimization can be difficult. Excessive wash-water flows should be avoided because excessive wash-water passing downward through a column creates an undesirable reduction in the slurry residence time in the froth, and a possible reduction in recovery. High water additions may also destabilize the froth by stripping surfactant from the surface of the bubbles, and may act to decrease product grade by increasing axial froth mixing, reducing wash-water effectiveness. It may also produce excessively dilute column tailings products which are difficult to thicken. It would be advantageous if the reliance on wash-water could be reduced or eliminated, and lower hydrophobicity and hydrophilic material could be removed by interstitial water displacement without reliance on a clean wash-water supply.

The typical flotation column, as discussed supra, contains a froth zone floating on a liquid zone, and injects a feed slurry into the liquid zone. Bubbles are generated and introduced into the liquid zone with the feed, and collision between the bubbles and the hydrophobic particles is relied upon to create the necessary bubble-particle aggregate which then reports to the froth zone. This arrangement levies a number of significant requirements. Numerous efforts are aimed toward increasing the probability of bubble-particle collision, reducing the degree to which hydrophobic particles are sheared off as bubbles transition from liquid to froth, and maintaining an optimum ratio of bubble size to particle size. The latter in particular places significant operational constraints on a separation process, as a bubble size too large relative to the hydrophobic particle results in the particle sweeping around the bubble, rather than colliding, and a bubble size too small relative to the hydrophobic particle may have insufficient buoyancy with which to carry the particle to the froth zone. In either case, a significant amount of the hydrophobic material reports to the tailings stream. These issues can be somewhat mitigated by injection of the feed stream directly into the froth zone, as opposed to the liquid. Particle collection rates using froth injection are generally higher than injection into the liquid zone due to short collision path lengths and high interfacial bubble area per unit volume in the froth. Additionally, turbulence in the froth is low, reducing the tendency for attached particles to break away from bubbles, and particles may adhere to several bubbles, rather than just one as typically occurs in liquid zone bubble-particle collisions. As a result, froth injection is particularly effective for coarse particles, allowing capture of particles 5-10 times the upper limiting size for liquid injection columns. This directly impacts the crushing and grinding requirements prior to introduction of the particles into the separation column. Fine particle collection is also enhanced, as the particles are introduced to the bubble bed and the tendency of these low inertia particles to follow bubble streamlines and avoid capture is mitigated Such froth injection systems are known. See, e.g., Schultz et al, "The flotation column as a froth separator," *Mining Engr.* 1450 (1991). However, the main drawback to froth injection is the poor selectivity among particles of varying hydrophobicity. Some finite recovery of small hydrophilic particles is always observed in froth injection. See Nguyen et al, *Colloidal science of flotation*, Marcel Dekker, New York (2004). It would be advantageous to provide a method whereby froth injection is utilized for a high degree of particle collection from a feed, but carryover of lower hydrophobic or hydrophilic particles to the froth overflow could be substantially minimized.

Accordingly, it is an object of this disclosure to provide a method of operating a flotation column where froth injection is utilized for a high degree of particle collection with reduced carryover of lower hydrophobic or hydrophilic particles to the froth overflow.

Further, it is an object of this disclosure to provide a method of operating a flotation column where froth injection is utilized and control over end-product recovery and grade is available through adjustment of a limited number of discrete operating parameters.

Further, it is an object of this disclosure to provide a method of operating a flotation column where froth injection is utilized and lower hydrophobic and hydrophilic material is removed by interstitial water displacement with reduced or eliminated reliance on a clean wash-water supply.

Further, it is an object of this disclosure to provide a method of operating a flotation column allowing capture of coarse particles beyond the upper limiting size for liquid injection columns.

Further, it is an object of this disclosure to provide a method of operating a flotation column allowing capture of fine particle by introducing the fine particles directly to a bubble bed, mitigating the tendency of the low inertia particles to follow bubble streamlines and avoid capture.

These and other objects, aspects, and advantages of the present disclosure will become better understood with reference to the accompanying description and claims.

SUMMARY OF INVENTION

The disclosure herein provides a method of particle separation from a feed stream comprised of particles of varying hydrophobicity by injecting the feed stream directly into the froth zone of vertical flotation column in the presence of a counter-current reflux stream.

A feed stream comprised of particles of varying hydrophobicity is injected directly into the froth zone of a vertical flotation column. The injection of the feed stream into the froth zone results in the creation of bubble-particle attachments between a plurality of bubbles in the froth zone and the hydrophobic particles. Injection into the froth zone offers significant advantage because the interfacial bubble area per unit volume in the froth is very high, collision path lengths are short, and turbulence is low, leading to significantly higher particle collection rates. Additionally, the particles may adhere to several bubbles, making the method particularly effective for coarse particles, and recovery of smaller fines is increased as the fines become less likely to sweep around a bubble's streamlines in the more densely packed froth. This allows significantly higher feed rates for a given recovery and grade of concentrate stream as compared to a column relying on particle capture in a liquid collection zone, and elimination of the liquid collection zone greatly reduces the physical footprint of the vertical flotation column.

The method offers a means by which the poor selectivity typically experienced with direct froth injection methods is addressed, such that froth injection may be utilized for increased recovery while controlling the degree to which lower hydrophobicity particles are carried in the froth. As the froth moves upward through the froth zone, some of the bubble-particle aggregates experience detachment and enter the interstitial liquid. The detachment rate depends on the particle's strength of attachment and the presence of other mechanisms which encourage detachment, and is generally treated as inversely proportional to the hydrophobicity of the particle. Bubble coalescence in the froth may also occur, preferentially releasing lower hydrophobicity particles into the interstitial liquid.

The hydrophobic particles carried by the froth to froth overflow are transferred to a froth breaker where the bubbles comprising the froth in the froth overflow are intentionally disrupted, liberating the particles comprising the bubble-particle attachments and forming a slurry. A portion of the slurry is drawn off as a concentrate stream and the remaining portion of the slurry is returned to froth zone as a reflux stream. The introduction of the reflux stream improves the hydrophobic selectivity of the froth zone by increasing the concentration of the more hydrophobic particles in the interstitial liquid existing between the bubbles. This increases the likelihood that when less hydrophobic particles undergo detachment and enter the interstitial liquid, the more hydrophobic particles available in the interstitial liquid via the reflux stream will form bubble-particle attachments. The less hydrophobic particles are then increasingly likely to drain downward with the draining interstitial liquid and ultimately exit the vertical flotation column through the tailings stream. As a result, the grade of the product reporting to the froth overflow increases, and the grade of the slurry drawn off as the concentrate stream increases. Additionally, the reflux stream increases the downward flow of liquid through the froth zone to enhance draining action and further sweep unattached, less hydrophobic particles toward the tailings stream. This significantly reduces and can eliminate the wash-water requirements present in the conventional approach.

The mass flow rate of the reflux stream may be varied in order to control the resulting grade of concentrate stream as operating conditions change. In addition, the vertical level of feed injection into the froth zone may be varied. An operating advantage of the method described herein is the ability to influence recovery and grade somewhat independently, by varying both the vertical level of feed stream and the magnitude of reflux stream, adding significant operational flexibility. Further, the method described substantially increases the maximum particle size typically recovered using conventional coal flotation. In conventional coal flotation, spiral circuits are typically utilized for recovery of particles having greater than 0.2 mm diameter. In an exemplary operation of this method using a coal slurry feed stream, a maximum particle size of +1.0 mm was recovered. Use of this method may therefore reduce the complexity of a plant by eliminating the need for spiral circuits.

The method thus provides particle separation by utilizing feed injection directly into the froth zone of a vertical flotation column combined with interstitial liquid displacement using reflux. The method facilitates removal of lower hydrophobicity particles from bubbles surfaces, offers simplified operational control, reduces or eliminates wash-water requirements, and reduces crushing and burdens by allowing capture of coarse particles beyond the upper limiting size for liquid injection columns, among other advantages. The method generally comprises: (1) generating a froth zone in a vertical flotation column having a vertical axis; (2) injecting the feed stream into the froth zone; (3) transferring and breaking froth overflow, producing a slurry; (3) injecting a reflux stream into the froth zone; (4) generating a concentrate stream and (5) generating a tailings stream.

The various features of novelty which characterize this disclosure are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the disclosure is illustrated.

DETAILED DESCRIPTION OF THE PREFERRED EMBODIMENTS

The following description is provided to enable any person skilled in the art to use the invention and sets forth the best mode contemplated by the inventor for carrying out the invention. Various modifications, however, will remain readily apparent to those skilled in the art, since the principles of the present invention are defined herein specifically to provide a method of particle separation using injection directly into the froth zone of a vertical flotation column coupled with interstitial liquid displacement using reflux, in a manner which facilitates removal of lower hydrophobicity particles from bubbles surfaces, offers simplified operational control, reduces or eliminates wash-water requirements, and reduces crushing and burdens by allowing capture of coarse particles beyond the upper limiting size for liquid injection columns.

Principles

Figure 1:
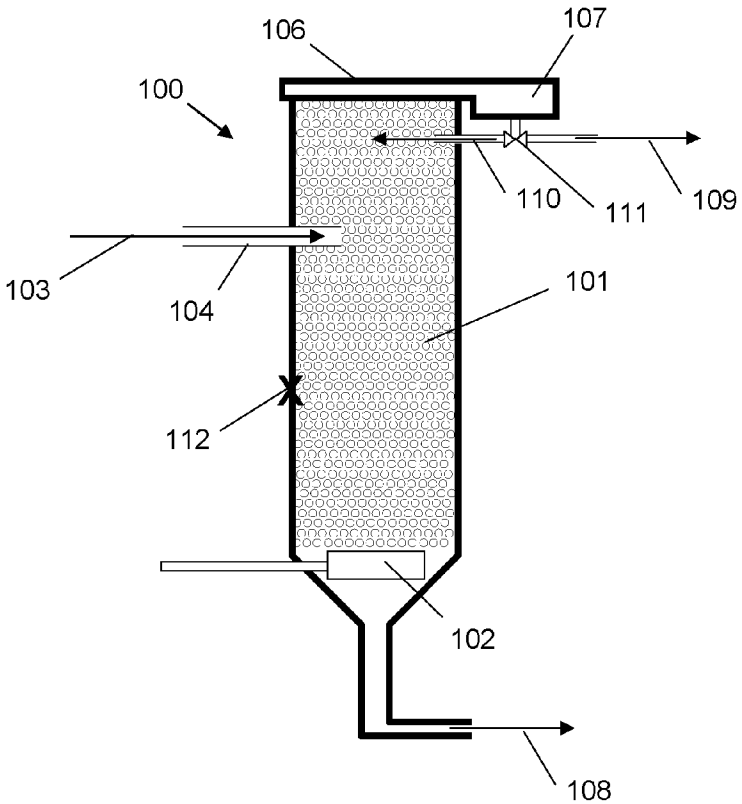
FIG. 1 illustrates a vertical flotation column for particle separation utilizing feed injection to the froth zone and a counter-current reflux stream.

Principles of the method may be illustrated with reference to FIG. 1. FIG. 1 shows a vertical flotation column 100 having a froth zone 101 generated by a bubble generator 102. Bubble generator 102 emits gaseous bubbles having a liquid film which move vertically upward from bubble generator 102 into froth zone 101. This emission of bubbles produces a froth zone 101 comprised of a plurality of bubbles moving vertically upward through vertical flotation column 100.

Feed stream 103 is injected directly into froth zone 101 through feed inlet 104 as illustrated. Feed stream 103 is comprised of particles of varying hydrophobicity. For example, feed stream 103 may be an aqueous coal slurry containing ground particles of coal and clay minerals, where the clay minerals may be present as physically independent particles from the coal particles, or the clay may compromise part of the coal particle as interstitial or slime coatings. In either case, the coal is generally naturally hydrophobic while the clay is generally naturally hydrophilic, such that a feed stream 103 containing coal and clay as physically independent particles or where the clay comprises part of the coal particle results in a feed stream 103 comprised of particles of varying hydrophobicity. Feed stream 103 may also be treated with surfactants and other agents known in the art to further manipulate the hydrophobicity of various particles within feed stream 103.

The injection of feed stream 103 into froth zone 101 results in the creation of bubble-particle attachments due to contact with the plurality of bubbles and the hydrophobicity of the particles. Generally speaking, a hydrophobic particle is a particle which forms relatively low-energy bonds (or other interactions) with water. During a collision with a bubble, a portion of the particle surface can leave the water and enter the air phase inside the bubble, and therefore achieve a lower energy state. In contrast, hydrophilic particles form relatively high-energy bonds with water, so the energy is not decreased when part of the surface enters and encounters the gaseous interior. As a result, the particle does not attach to the bubble. Flotation thus separates mixtures of hydrophobic/hydrophilic particles, based on differences in the hydrophobic or hydrophilic nature of the individual particle surfaces.

An advantage of the method disclosed here is injection of feed stream 103 directly into froth zone 101. As discussed supra, conventional operation specifies a froth zone floating atop a liquid zone, and injection of a feed stream into the liquid zone. In these arrangements, as bubbles pass upward through the liquid zone into the froth zone, the likelihood of bubble-particle attachment depends on a variety of factors, including a probability of collision between a particle and a bubble in the liquid zone, and a proper bubble size relative to the particle. Additionally, in liquid zone injections, the bubble-particle combination experiences shearing forces while transitioning from the liquid zone to the froth zone, and the probability that the particle will remain attached during this transition is an important consideration. However, liquid zone injection remains the conventional approach because of the selectivity afforded. The hydrophobicity of the particle in the bubble-particle attachment affects the shearing probability, and particles of greater hydrophobicity are more likely to maintain attachment during the transition and report to the froth zone. Optimizing the selectivity based on operating parameters of the column is difficult, however, and remains a source of significant ongoing effort.

By contrast, the method disclosed herein utilizes injection directly into froth zone 101, and does not require the presence of a liquid zone within which bubble-particle collisions occur. This offers significant advantage because the interfacial bubble area per unit volume in the froth is very high. Combined with the short collision path lengths existing in the froth zone 101 as compared to a liquid zone, this leads to significantly higher particle collection rates. Additionally, in the froth zone 101 turbulence is low, and the tendency for particles to break away from bubbles is reduced. The particles may also adhere to several bubbles, rather than just one, mitigating the strict relationship between bubble and particle size as exists in liquid zone injection. Injection directly into the froth therefore becomes particularly effective for coarse particles, which are difficult to transport to the froth phase by bubble rise in conventional flotation. Recovery of smaller fines is also increased, as the fines become less likely to sweep around a bubble's streamlines in the more densely packed froth. Additionally, the carrying capacity of the vertical flotation column is greatly increased, as the liquid collection zone typically present in conventional practice can be substantially replaced by the froth zone. This allows significantly higher feed rates for a given recovery and grade of concentrate stream 106 as compared to column relying on particle capture in a liquid collection zone. Alternatively, because reliance on feed injection directly into the froth eliminates the requirement for a liquid collection zone below the froth zone, the physical footprint of the vertical flotation column may be greatly reduced. However, as discussed previously, froth injection as currently practiced generally produces poor selectivity among particles of varying hydrophobicity. Previous efforts of froth injection have produced a higher recovery of the valuable particle from the feed stream, but the short collision length and lower turbulence results in a wide range of hydrophobic particles also being carried in the froth. In the case of, for example, coal recovery from a feed stream containing both valuable coal ore and undesired clay, pyrite, and other constituents, froth injection may increase coal recovery but decrease the combustible potential of the recovered product, due to unavoidable inclusion of the low-value components. This lack of selectivity has discouraged froth injection in such applications. The method disclosed herein offers a means by which froth injection may be utilized for increased recovery while controlling the degree to which lower hydrophobicity particles are carried in the froth, as discussed infra.

Referring to FIG. 1, the plurality of bubbles comprising froth zone 101 moves vertically upward toward froth overflow 106. Due to the injection of feed stream 103, bubble-particle attachments have occurred in froth zone 101 between some portion of the plurality of bubbles and some portion of the particles of varying hydrophobicity. As the froth moves upward through froth zone 101, some of the bubble-particle aggregates experience detachment.

Detachment is a known phenomena in particle-laden froths and refers to the loss of hydrophobic particles from the bubble surfaces. This results in particles in a bubble-particle aggregate detaching from the bubble films and entering the interstitial liquid, at a rate which depends on the particle's strength of attachment and the presence of other mechanisms which encourage detachment. The reason for this behavior is not definitively known but the effect is well established. Often, detachment is considered proportional to the surface load of the bubbles and expressed using a detachment coefficient having the dimensions of the inverse of time. See e.g., Chahed et al, "Gas-Liquid Mass Transfer Approach applied to the Modeling of Flotation in a Bubble Column," *Chem. Eng. Technol.* 31 (2008), see also King, *Modeling and Simulation*

*of Mineral Processing Systems*, Butterworth-Heinemann Ltd, Oxford (2001), among others. Generally speaking, the detachment rate constant is assumed to be inversely proportional to the hydrophobicity of the particle, and more hydrophobic materials have a greater tendency to remain attached. As a result, this detachment provides some degree of selectivity, as less hydrophobic particles have a greater tendency to detach from a bubble surface and enter the surrounding interstitial liquid.

Additionally, as is understood in the art, as the plurality of bubbles moves upward through froth zone 101, bubble coalescence may occur, causing a reduction of the bubble surface area. This also leads to preferential detachment of lower hydrophobicity particles, providing another degree of selectivity. See e.g., Fuerstenau et al, *Froth Flotation: A Century of Innovation*, Society for Mining Metallurgy, Littleton, Colo. (2007), among others. As discussed supra, bubble coalescence is controlled by many factors, and this mode of selectivity may or may not be significantly present in the operation of the vertical flotation column illustrated at FIG. 1.

The hydrophobic particles carried by the froth to froth overflow 106 are transferred to froth breaker 107, where the bubbles comprising the froth in the froth overflow are intentionally disrupted, liberating the particles comprising the bubble-particle attachments and forming a slurry. The slurry is expected to contain a mixture of particles of varying hydrophobicity due to imperfect selectivity in bubble-particle attachment and detachment occurring in froth zone 101, as well as the non-selective mechanism of entrainment in the interstitial liquid. A portion of the slurry is drawn off as concentrate stream 109. The remaining portion of the slurry is returned to froth zone 101 as reflux stream 110 at a vertical level above the feed inlet 104.

The introduction of reflux stream 110 acts to improve the hydrophobic selectivity of froth zone 101 by increasing the concentration of the more hydrophobic particles in the interstitial liquid existing between the bubbles. This increases the likelihood that when less hydrophobic particles undergo detachment and enter the interstitial liquid, the more hydrophobic particles available in the interstitial liquid via reflux stream 110 will form bubble-particle attachments. The less hydrophobic particles are then increasingly likely to drain downward with the draining interstitial liquid and ultimately exit vertical flotation column 100 through tailings stream 108. It is understood that a portion of these less hydrophobic particles may reattach during downward descent through the froth, however the combination of particle detachment and reflux stream 110 significantly mitigates the likelihood that the less hydrophobic particles will remain attached as the froth moves upward and reaches the vertical level of froth overflow 106. As a result, the grade of the product reporting to froth overflow 106 increases, and the grade of the slurry drawn off as concentrate stream 109 increases. Additionally, as reflux stream 110 is introduced into froth zone 101 and combines with the interstitial liquid, the increased downward flow of liquid through froth zone 101 enhances draining action and further sweeps unattached, less hydrophobic particles through froth zone 101 and toward tailings stream 108. This significantly reduces and can eliminate the wash-water requirements present in the conventional approach.

Reflux stream 110 is illustrated at FIG. 1 entering froth zone 101 at a level above feed stream 103 on the vertical axis of vertical flotation column 100, however this is not strictly necessary within this method. As is understood in the art, particle detachment is expected to occur throughout froth zone 101, and the increased concentration of more hydrophobic particles in the interstitial liquid will increase the likelihood that the more hydrophobic particles attach and the less hydrophobic particles drain downward and ultimately exit vertical flotation column 100 through tailings stream 108, as the addition of reflux stream 110 results in counter-current flow between the interstitial liquid and the plurality of bubbles moving upward through vertical flotation column 100.

Further, and significantly, the magnitude of reflux stream 110 diverted from froth breaker 107 may be controlled with a mechanism such as control valve 111, in order to maintain the resulting grade of concentrate stream 109 as operating conditions change, or in order to intentionally vary the resulting grade of concentrate stream 109 when desired.

In addition, the vertical flotation column 100 may have a plurality of feed inlets such that the vertical level of feed injection into froth zone 101 may be varied. For example, a plurality of feed inlets could also provide for injection of feed stream 103 into froth zone 101 at feed location 112. This has direct impact on the extent of selectivity which occurs as the froth moves upward through froth zone 101, and thus impacts both the recovery and grade of the valuable constituent in feed stream 103. Generally, the recovery of valuable ores increases as the vertical level of the feed injection increases. However, as previously discussed, the recovery of undesired particles is also expected to increase, reducing the grade of concentrate stream 109 in the absence of other changes. One of the operating advantages of the method described herein is the ability to influence recovery and grade somewhat independently, by varying both the vertical level of feed stream 103 with a plurality of feed inlets and the magnitude of reflux stream 110 with control valve 111. This arrangement adds significant operational flexibility.

Further, the method described substantially increases the maximum particle size typically recovered using conventional coal flotation. In conventional coal flotation, 0.2 mm is the general size above which a substantial decrease in recovery occurs, and spiral circuits are typically utilized for particles of greater diameter. In an exemplary operation of this method using a coal slurry feed stream, a maximum particle size of +1.0 mm was recovered. Use of this method may therefore reduce the complexity of a plant by eliminating the need for spiral circuits.

It is also understood that while the principles have been discussed with reference to recovery of a more hydrophobic particle via concentrate stream 109 from feed stream 103 comprised of more hydrophobic and less hydrophobic particles, the method may also be readily applied for the purpose of recovering the less hydrophobic particle via tailings stream 108.

Detailed Description of the Method

The method of particle separation disclosed herein utilizes injection directly into the froth zone of a vertical flotation column combined with interstitial liquid displacement using reflux, in a manner which facilitates removal of lower hydrophobicity particles from bubbles surfaces, offers simplified operational control, reduces or eliminates wash-water requirements, and reduces crushing and burdens by allowing capture of coarse particles beyond the upper limiting size for liquid injection columns. The novel method generally comprises: (1) generating a froth zone in a vertical flotation column having a vertical axis; (2) injecting the feed stream into the froth zone; (3) transferring and breaking froth overflow, producing a slurry; (3) injecting a reflux stream into the froth zone; (4) generating a concentrate stream and (5) generating a tailings stream.

Generating a Froth Zone in a Vertical Flotation Column Having a Vertical Axis:

The froth zone 101 may be generated in a variety of ways known to those skilled in the art. FIG. 1 illustrates a typical method using bubble generator 102. Bubble generator 102 may be substantially at the base of froth zone 101, or may be within a liquid layer below froth zone 101, where the liquid layer is comprised of interstitial liquid draining from froth zone 101. Bubble generator 102 may also be an external bubble generator. Bubble generators and methods of operation for the purpose of producing a froth zone in a vertical flotation column are well known. See, e.g., U.S. Pat. No. 5,167,798 issued to Yoon et al, issued Dec. 1, 1992, among others. Bubble generator 102 may also operate as a plunging jet, a venturi, a static mixer, or a sparger or porous-walled pipe through which air is introduced in a turbulent fashion. The specific means by which the froth zone 101 is produced is not critical to the method disclosed herein. Within this method, it is only necessary to generate froth zone 101 comprised of a plurality of bubbles moving vertically upward through vertical flotation column 100.

Typically, air will be utilized as the gas for bubble generator 102, but other gases may be utilized if the conditions warrant. The plurality of bubbles generated by bubble generator 102 are separated in froth zone 101 by an aqueous interstitial liquid, in order to take advantage of the hydrophobic characteristics of the particles to be separated.

A frother may be utilized to stabilize the plurality of bubbles so that they remain well-dispersed and form a stable froth without significant bubble coalescence. The most commonly used frothers are alcohols, particularly methyl isobutyl carbinol or any of a number of polyglycols.

Injecting the Feed Stream into the Froth Zone:

Feed stream 103 is injected into froth zone 101 at a vertical feed injection level with respect to the vertical axis of vertical flotation column 100. For example, the vertical location of feed inlet 104, or feed location 112, as illustrated at FIG. 1.

Feed stream 103 may be a feed slurry comprised of a liquid and the particles of varying hydrophobicity, for example, an aqueous slurry containing a valuable ore mineral and waste gangue having various degrees of hydrophobicity. Feed stream 103 may also comprise surfactant or collector chemicals, such as xanthates, dithiophosphates, or other compounds known to be effective in a specific application. Feed stream 103 may also be a dry feed of particles of varying hydrophobicity.

Feed stream 103 may be an aqueous coal slurry containing ground particles of coal and clay, pyrite, and other constituents. Any type coal can be employed in the method herein. Typically, these include, for example, bituminous coal, subbituminous coal, anthracite, lignite and the like. Other solid carbonaceous fuel materials, such as oil shale, tar sands, coke, graphite, mine tailings, coal from refuse piles, coal processing fines, coal fines from mine ponds or tailings, and the like are also contemplated for treatment by the process herein.

The maximum particle diameter of particles in feed stream 103 depends on the particles to be separated and the desired recovery and grade of concentrate stream 109 or tailings stream 108. In an exemplary operation using a coal slurry feed stream, a maximum particle size greater than 1.0 mm was recovered. Preferably, the maximum particle size does not exceed a 2.0 mm diameter. These maximum particle sizes represent a substantial increase over typical particle sizes recovered using conventional coal flotation, where generally 0.2 mm is the size above which a substantial decrease in recovery occurs and spiral circuits are typically utilized. The method may therefore reduce the complexity of a plant by eliminating spiral circuits and including larger sizes in the column feed.

Feed stream 103 may also be a pressurized slurry feed comprised of a dissolved gas, such as air. This may aid the preferential recovery of small particles as the dissolved gas is released upon introduction of the pressurized slurry feed into a lower pressure vertical flotation column.

Feed stream 103 may be injected into froth zone 101 in a continuous or batch process. In an exemplary application using a laboratory column of approximately 5 cm diameter and a froth zone height of approximately 50 cm, a continuous coal slurry feed rate of up to 600 ml/min and air flow rates to the bubble generator up to 2.0 SCFH were utilized to achieve product yields as high as 86.4% and ash yields as low as 6.1%.

Figure 2:
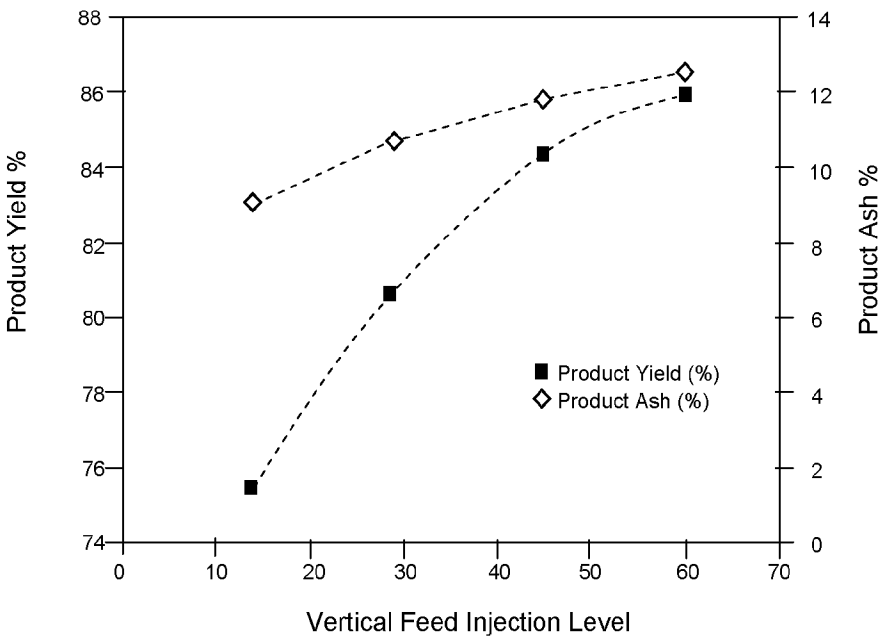
FIG. 2 illustrates the impact of varying feed injection level on concentrate stream recovery and grade.

The vertical feed injection level may be varied in order to vary the recovery of the higher hydrophobicity particles in the froth overflow. FIG. 2 illustrates the impact of varying feed height on product and ash yields in an exemplary laboratory column of approximately 5 cm diameter and a froth zone height of approximately 50 cm, with a continuous coal slurry feed rate of 400 ml/min. Feed injections directly into the froth zone of the laboratory column are illustrated for vertical feed injection levels of approximately 14 cm, 29 cm, 45 cm, and 60 cm. Both the product yield and the ash yield increase with an increase in the vertical feed injection level.

Feed rates may be optimized by determining the contents of concentrate and tailings streams under various operating conditions of froth zone height, vertical feed injection level, air flow rates, and the like, in order to identify advantageous operating conditions based on specific applications.

Transferring and Breaking Froth Overflow, Producing a Slurry:

The froth from froth zone 101 exits vertical flotation column 100 into forth overflow 106 and is transferred to froth breaker 107. Froth breaker 107 may be any of several froth breaking methods, including paddles, screens, heating, particle additions, or other methods known in the art. Within froth breaker 107, bubble-particle aggregates are disrupted to produce an aqueous slurry comprised of some portion of the particles of varying hydrophobicity introduced to vertical flotation column 100 via feed stream 103.

Injecting a Reflux Stream into the Froth Zone:

The slurry produced in froth breaker 107 exits froth breaker 107 and is split into reflux stream 110 and concentrate stream 109. Any suitable means for splitting an incoming flow into multiple flows may be utilized. For example, the reflux stream 110 may be generated using control valve 111, where control valve 111 is a flow-divider valve receiving one input flow from froth breaker 107 and splitting it into the two output flows of reflux stream 110 and concentrate stream 109, where the flow-divider valve may be adjusted to provide a predetermined ratio of flows.

Reflux stream 110 is injected into froth zone 101 and mixes with interstitial liquid in froth zone 101, and must be provided at a sufficient mass flow rate such that a net flow of interstitial liquid flows in a downward direction below the reflux injection level. This provides a counter-current flow between the plurality of bubbles and the interstitial liquid below the vertical level of the reflux stream. A net flow of interstitial liquid in a downward direction is achieved when the water rate of tailings stream 108 exceeds the water rate of reflux stream 110 and concentrate stream 109.

Figure 3:
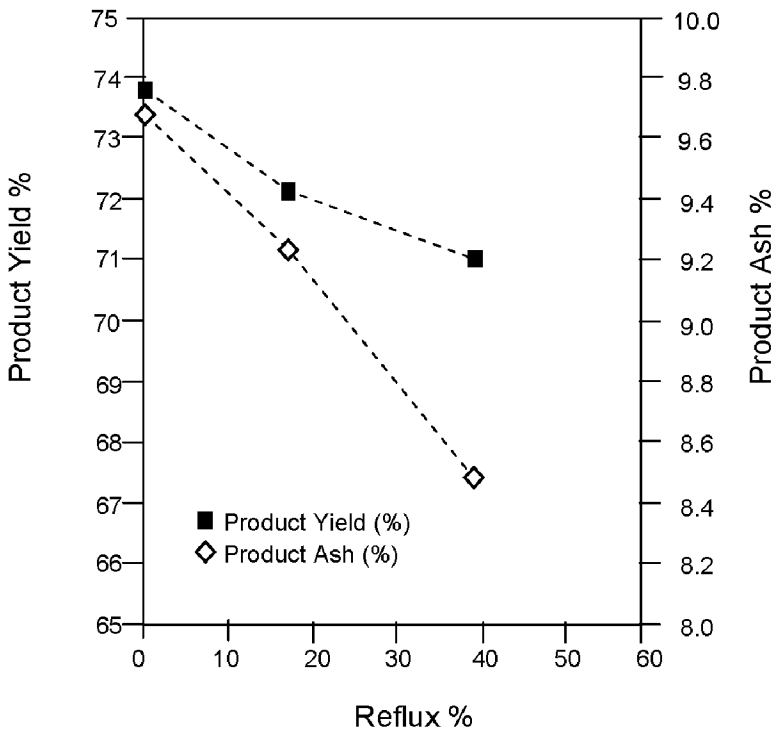
FIG. 3 illustrates the impact of varying reflux stream flow rate on concentrate stream recovery and grade.

The injection of reflux stream 110 into froth zone 101 and the subsequent mixing with the interstitial liquid, combined with the net flow of interstitial liquid in the downward direction, produces a counter-current flow between particles in the reflux stream 110 and some portion of the plurality of bubbles moving upward through froth zone 101, allowing higher hydrophobicity particles introduced via reflux stream 110 to attach to bubble surfaces as lower hydrophobicity particles detach. This allows varying the reflux ratio of reflux stream 110 in order to reduce the recovery of the lower hydrophobicity particles in the froth overflow. Here, reflux ratio means the ratio of reflux stream 110 divided by the combined mass flow of both reflux stream 110 and concentrate stream 109. FIG. 3 illustrates the impact of varying the reflux ratio on product and ash yields in an exemplary laboratory column of approximately 5 cm diameter and a froth zone height of approximately 50 cm with a continuous coal slurry feed, with the reflux stream injected at approximately the top of the froth zone. As illustrated, both the product yield and the ash yield decrease as reflux ratio was increased from 0 to approximately 40%. At 40% reflux ratio, the product ash yield is reduced approximately 12% below the level achieved with 0% reflux ratio.

Wash-water may be added to froth zone 101, however the addition of wash-water is not required within the method disclosed herein.

Generating a Concentrate Stream and a Tailings Stream:

Tailings stream 108 exits vertical flotation column 100 below the vertical feed injection level, as illustrated at FIG. 1. Tailings stream 108 is comprised of particles which enter vertical flotation column 100 via feed injection 103 and are not floated or entrained to concentrate stream 109. As discussed, concentrate stream 109 is comprised of that portion of the slurry generated within froth breaker 107 which is not utilized for reflux stream 110.

It is understood that while the method herein is discussed mainly with reference to recovery of a more hydrophobic particle via concentrate stream 109 from feed stream 103, the method may also be readily applied for the purpose of recovering a less hydrophobic or hydrophilic particle via tailings stream 108.

The method disclosed thus provides particle separation from a feed stream comprised of particles of varying hydrophobicity by generating a froth zone in a vertical flotation column. The feed stream is injected into the froth zone, thereby generating bubble-particle attachments, and froth overflow is transferred to a froth breaker. The froth breaker generates a reflux stream and a concentrate stream, and the reflux stream is injected into the froth zone of the vertical flotation column, such that the reflux stream mixes with the interstitial liquid between bubbles in the froth zone. A net flow of interstitial liquid flows in a downward direction provides a counter-current flow between the plurality of bubbles and the interstitial liquid, allowing higher hydrophobicity particles introduced via the reflux stream to attach to bubble surfaces as lower hydrophobicity particles detach. The height of the feed stream injection and the reflux ratio may be varied in order to optimize the concentrate or tailing stream recoveries desired based on existing operating conditions or other considerations.

The disclosure thus provides a method of operating a flotation column where froth injection is utilized for a high degree of particle collection with reduced carryover of lower hydrophobic or hydrophilic particles to the froth overflow.

Further, the disclosure provides a method of operating a flotation column where froth injection is utilized and control over end-product recovery and grade is available through adjustment of a limited number of discrete operating parameters Further, the disclosure provides a method of operating a flotation column where froth injection is utilized and lower hydrophobic and hydrophilic material is removed by interstitial water displacement with reduced or eliminated reliance on a clean wash-water supply.

Further, the disclosure provides a method of operating a flotation column allowing capture of coarse particles beyond the upper limiting size for liquid injection columns.

Further, the disclosure provides a method of operating a flotation column allowing capture of fine particle by introducing the fine particles directly to a bubble bed, mitigating the tendency of the low inertia particles to follow bubble streamlines and avoid capture.

Having described the basic concept of the invention, it will be apparent to those skilled in the art that the foregoing detailed disclosure is intended to be presented by way of example only, and is not limiting. Various alterations, improvements, and modifications are intended to be suggested and are within the scope and spirit of the present invention. Additionally, the recited order of elements or sequences, or the use of numbers, letters, or other designations therefore, is not intended to limit the claimed processes to any order except as may be specified in the claims. Accordingly, the invention is limited only by the following claims and equivalents thereto.

All publications and patent documents cited in this application are incorporated by reference in their entirety for purposes to the same extent as it each individual publication or patent document were so individually denoted.

The invention claimed is:

1. A method of separating particles of varying hydrophobicity by dividing a feed stream comprised of the particles of varying hydrophobicity into a concentrate stream and a tailings stream, comprising:

Generating a froth zone in a vertical flotation column having a vertical axis, where the froth zone is comprised of a plurality of bubbles moving vertically upward through the vertical flotation column and exiting the vertical flotation column to produce a froth overflow at a vertical froth overflow level on the vertical axis, and where the plurality of bubbles is separated by an aqueous interstitial liquid;

Injecting the feed stream into the froth zone at a vertical feed injection level on the vertical axis, thereby generating bubble-particle attachments in the froth zone between some portion of the plurality of bubbles and some portion of the particles of varying hydrophobicity;

Transferring the froth overflow to a froth breaker and breaking the froth overflow, thereby producing a slurry;

generating a reflux stream, where the reflux stream is comprised of a first fraction of the slurry, and injecting the reflux stream into the froth zone of the vertical flotation column at a reflux injection level on the vertical axis, such that the reflux stream mixes with the aqueous interstitial liquid and the interstitial liquid is comprised of the reflux stream, and such that a net flow of the aqueous interstitial liquid flows in a downward direction below the reflux injection level, thereby providing a counter-current flow between the plurality of bubbles and the aqueous interstitial liquid below the vertical level of the reflux stream;

generating the concentrate stream, where the concentrate stream is comprised of a second fraction of the slurry; and generating the tailings stream, where the tailings stream exits the vertical flotation column below the vertical feed injection level, thereby conducting a method of separating the particles of varying hydrophobicity by dividing the feed stream comprised of the particles of varying hydrophobicity into the concentrate stream and the tailings stream.

2. The method of claim 1 where the aqueous interstitial liquid is further comprised of a wash-water stream.

3. The method of claim 1 where the feed stream is further comprised of a liquid.

4. The method of claim 1 where the particles of varying hydrophobicity are comprised of higher hydrophobicity particles and lower hydrophobicity particles, and where the first fraction of the slurry comprising the reflux stream is varied in order to vary a percentage of lower hydrophobicity particles in the froth overflow.

5. The method of claim 1 where the particles of varying hydrophobicity are comprised of higher hydrophobicity particles and lower hydrophobicity particles and the vertical feed injection level is varied in order to vary a percentage of higher hydrophobicity particles in the froth overflow.

6. The method of claim 1 where the reflux injection level is between the vertical feed injection level and the vertical froth overflow level.

7. The method of claim 1 where the net flow of interstitial liquid is established by maintaining the mass flow rate of the tailings stream greater than the combined mass flow rate of the reflux stream and the concentrate stream.

8. The method of claim 1 where the feed stream is comprised of a plurality of particles having maximum diameter greater than 1.0 mm, and where a portion of the plurality of particles report to the froth breaker by hydrophobic attachment between the portion of the plurality of particles and a portion of the plurality of bubbles in the froth zone.

9. The method of claim 1 where the feed stream is comprised of an aqueous coal slurry containing ground particles of coal and clay, pyrite, and other constituents.

10. The method of claim 1 where the feed stream is comprised of an aqueous coal slurry containing ground particles of bituminous coal, sub-bituminous coal, anthracite, or lignite.

11. The method of claim 1 where the feed stream is comprised of an aqueous slurry containing oil shale, tar sands, coke, graphite, mine tailings, coal from refuse piles, coal processing fines, or coal fines from mine ponds.

12. A method of separating particles of varying hydrophobicity from a feed stream comprised of an aqueous slurry of the particles of varying hydrophobicity into a concentrate stream and a tailings stream, comprising:

Generating a froth zone in a vertical flotation column having a vertical axis, where the froth zone is comprised of a plurality of bubbles moving vertically upward through the vertical flotation column and exiting the vertical flotation column to produce a froth overflow at a vertical froth overflow level on the vertical axis, and where the plurality of bubbles is separated by an aqueous interstitial liquid;

Injecting the feed stream into the froth zone at a vertical feed injection level on the vertical axis, thereby generating bubble-particle attachments in the froth zone between some portion of the plurality of bubbles and some portion of the particles of varying hydrophobicity, where the vertical feed injection level is selected from a plurality of available vertical feed injection levels based on desired characteristics of the concentrate stream;

Transferring the froth overflow to a froth breaker and breaking the froth overflow, thereby producing a slurry;

generating a reflux stream, where the reflux stream is comprised of a first fraction of the slurry, and injecting the reflux stream into the froth zone of the vertical flotation column at a reflux injection level on the vertical axis between the vertical feed injection level and the vertical froth overflow level, such that the reflux stream mixes with the aqueous interstitial liquid and the aqueous interstitial liquid is comprised of the reflux stream, where a mass flow rate of the first fraction of the slurry may be varied, and where the mass flow rate of the first fraction of the slurry is selected based on desired characteristics of the concentrate stream;

generating the concentrate stream, where the concentrate stream is comprised of a second fraction of the slurry;

generating the tailings stream, where the tailings stream exits the vertical flotation column below the vertical feed injection level; and maintaining a mass flow rate of the tailings stream greater than a combined mass flow rate of the reflux stream and the concentrate stream, such that a net flow of the aqueous interstitial liquid flows in a downward direction below the reflux injection level, thereby providing a counter-current flow between the plurality of bubbles and the aqueous interstitial liquid below the vertical level of the reflux stream, thereby conducting a method of separating the particles of varying hydrophobicity by dividing the feed stream comprised of the particles of varying hydrophobicity into the concentrate stream and the tailings stream.

13. The method of claim 12 where the aqueous interstitial liquid is further comprised of a wash-water stream.

14. The method of claim 12 where the particles of varying hydrophobicity are comprised of higher hydrophobicity particles and lower hydrophobicity particles, and where the mass flow rate of the first fraction of the slurry is varied in order to vary a percentage of lower hydrophobicity particles in the froth overflow.

15. The method of claim 12 where the particles of varying hydrophobicity are comprised of higher hydrophobicity particles and lower hydrophobicity particles and the vertical feed injection level is varied in order to vary a percentage of higher hydrophobicity particles in the froth overflow.

16. The method of claim 12 where the feed stream is comprised of a plurality of particles having maximum diameter greater than 1.0 mm, and where a portion of the plurality of particles report to the froth breaker by hydrophobic attachment between the portion of the plurality of particles and a portion of the plurality of bubbles in the froth zone.

17. The method of claim 12 where the feed stream is comprised of an aqueous coal slurry containing ground particles of coal and clay, pyrite, and other constituents.

18. The method of claim 12 where the feed stream is comprised of an aqueous coal slurry containing ground particles of bituminous coal, sub-bituminous coal, anthracite, or lignite.

19. The method of claim 12 where the feed stream is comprised of an aqueous slurry containing oil shale, tar sands, coke, graphite, mine tailings, coal from refuse piles, coal processing fines, or coal fines from mine ponds.

* * * * *